US005918652A

United States Patent [19]

Tucker

[11] Patent Number: 5,918,652

[45] Date of Patent: Jul. 6, 1999

[54] ROUTER BIT POSITIONING MECHANISM

[75] Inventor: Edwin C. Tucker, Ottawa, Canada

[73] Assignee: Lee Valley Tools Ltd., Ottawa, Canada

[21] Appl. No.: 09/143,016

[22] Filed: Aug. 28, 1998

[51] Int. Cl.[6] ..... B27M 1/00; B27C 5/00

[52] U.S. Cl. ..... 144/371; 33/642; 144/134.1; 144/135.2; 408/184; 409/218

[58] Field of Search ..... 409/184, 218, 409/181, 182; 33/642; 408/184, 221, 222, 2; 144/134.1, 135.2, 136.95, 154.5, 371, 329

[56] References Cited

U.S. PATENT DOCUMENTS

| | | | |
|---|---|---|---|
| 1,829,393 | 10/1931 | Carter | 409/184 |
| 1,889,653 | 11/1932 | Gorton | 409/184 |
| 3,435,730 | 4/1969 | Berberian | 409/184 |
| 3,710,833 | 1/1973 | Hammer et al. | 144/135.2 |
| 4,158,987 | 6/1979 | Smith | 144/135.2 |
| 4,537,234 | 8/1985 | Onsurd | 144/135.2 |
| 4,770,573 | 9/1988 | Monobe | 409/184 |
| 5,139,061 | 8/1992 | Neilson | 144/135.2 |
| 5,725,036 | 3/1998 | Walter | 144/154.5 |

OTHER PUBLICATIONS

Pages printed from The Old School Godney Wells Website (http://www.woodrat.com) related to the WoodRat Guide to Jointing, Sep. 13, 1998. It is admitted to have been known prior to Aug. 28, 1998.

*Primary Examiner*—W. Donald Bray
*Attorney, Agent, or Firm*—John S. Pratt; Kilpatrick Stockton LLP

[57] ABSTRACT

A mechanism that attaches to a plunge router, particularly when the router is used in a router table, to conveniently and accurately move the router body relative to the router base in order to adjust the position of a router bit in the router relative to the router table. Substantial excursions are made by moving a handle up or down using a handle or a foot pedal, and small excursions are made using a micro-adjust mechanism that has a detent set screw and cooperating structure to facilitate adjustment of the micro-adjust mechanism by very small predetermined increments.

29 Claims, 3 Drawing Sheets

ROUTER BIT POSITIONING MECHANISM

FIELD OF THE INVENTION

This invention relates to mechanisms for positioning router bits, particularly bits used in plunge routers being used in router tables.

BACKGROUND OF THE INVENTION

Adjusting the height of a router bit when the router is fixed in a table is frequently difficult. Doing so is particularly difficult when using a plunge router because a plunge router is not well designed for making small adjustments in the projection of the router bit by moving the router body relative to the base. Furthermore, plunge routers are designed to be used upright, and they typically include springs that balance the router weight so that the router body will not drop uncontrollably toward the base when the body and base are unlocked. When the router is upside down in a router table, the router body and base are urged apart from each other by the force of gravity and/or springs, introducing further grief in achieving desired adjustments in bit location.

Many plunge routers have a threaded adjusting rod attached to the router base and passing through or adjacent to a ledge or other structure that is part of, or is attached to, the router body. A nut or pair of locking nuts positioned on this adjusting rod and bearing against the ledge serves to fix the position of the router base relative to the body. After-market devices for adjusting the position of the base are available in which an internally threaded nut is attached to one end of a tube and a knob is attached to the other to tube end (where the knob is sufficiently clear of the router body to be readily accessible, at least when the router is an upright position). The nut is threaded onto the adjustment rod, and rotation of the knob rotates the nut around the rod and against the ledge. The knob on such devices can be relatively inaccessible, however, when the router is mounted under a router table, and its rotation moves the router body relative to the router base too slowly when substantial changes in router bit position are being made but too quickly for truly accurate adjustments because of the typically coarse pitch of the adjusting rod thread.

As a result, there is a substantial need for a mechanism for securing and conveniently and accurately adjusting the position of a plunge router when it is mounted upside down in a router table so that the projection of the router bit above the table can be closely controlled.

SUMMARY OF THE INVENTION

This invention is a mechanism that moves a tool it or a portion of it relative to another portion of the tool or other structure. The mechanism attaches to a plunge router, particularly when the router is used in a router table, to conveniently and accurately move the router body relative to the router base and lock the two in desired relative positions so that the adjustment of the position of a router bit relative to a router table may be also be accomplished conveniently and accurately. The mechanism is attached to the router base and bears against a ledge or other portion of the router body so that the body and base can be drawn toward each other or permitted to separate from each other.

In the embodiment of the invention described below, this is accomplished by attaching a plunger or piston to a threaded adjustment rod that is attached to the router base. (Such threaded rods are typically supplied with plunge routers). The piston is positioned to slide within a cylindrical opening or sleeve within a mechanism body. The position of the piston, and therefore the position of the router body relative to its base, it is controlled for relatively coarse position adjustments by a pivoting handle and, for fine adjustments in position, by a micro-adjust mechanism positionable in the bottom or lower end of the body. The micro-adjust mechanism utilizes a threaded spindle that may be moved axially by very small increments by rotating a knob on the lower end of the spindle. The piston rests on the top of the spindle and, therefore, is raised and lowered by the same small increments of axial movement of the spindle.

The mechanism body is an elongated sleeve having a cross-sectional shape similar to the letter Omega (Ω). The piston travels within a generally cylindrical passage in the body adjacent to an elongated groove defined by two parallel plates protruding from one side of the body. One end of the handle is positioned between the plates and pivots on a stud or screw that extends through the plates. The handle is attached by links to a piston arm that slides between the plates and within the groove and attaches to the piston. The handle may also be attached by a chain, rod or other link to a foot pedal so that changes in the position of the router body relative to its base may be made without use of the operator's hands. By providing multiple positions at which the link to the piston may be attached to the handle, the position of the handle (for a particular router bit position), and the excursion of the handle necessary to move the piston a particular distance, may be adjusted. Multiple attachment points on the handle for the chain, rod or other link to the foot pedal also make possible adjustment of the pedal excursion (for a particular range of bit movement). Such multiple attachment points also make it possible to adjust the force necessary to achieve a particular bit movement, since the mechanical advantage can be varied. Generally a relatively large handle excursion will result is a relatively small bit movement so that relatively little force is needed and a desired bit location is easy to achieve.

Each of the piston and the micro-adjust cylinder that are positioned within the cylindrical passage in the mechanism body may be locked in the body by squeezing it closed utilizing any of a variety of mechanism for doing so, such as threaded studs or screws operated by knobs or handles to draw the plates toward each other.

DETAILED DESCRIPTION OF THE DRAWINGS

Figure 1:
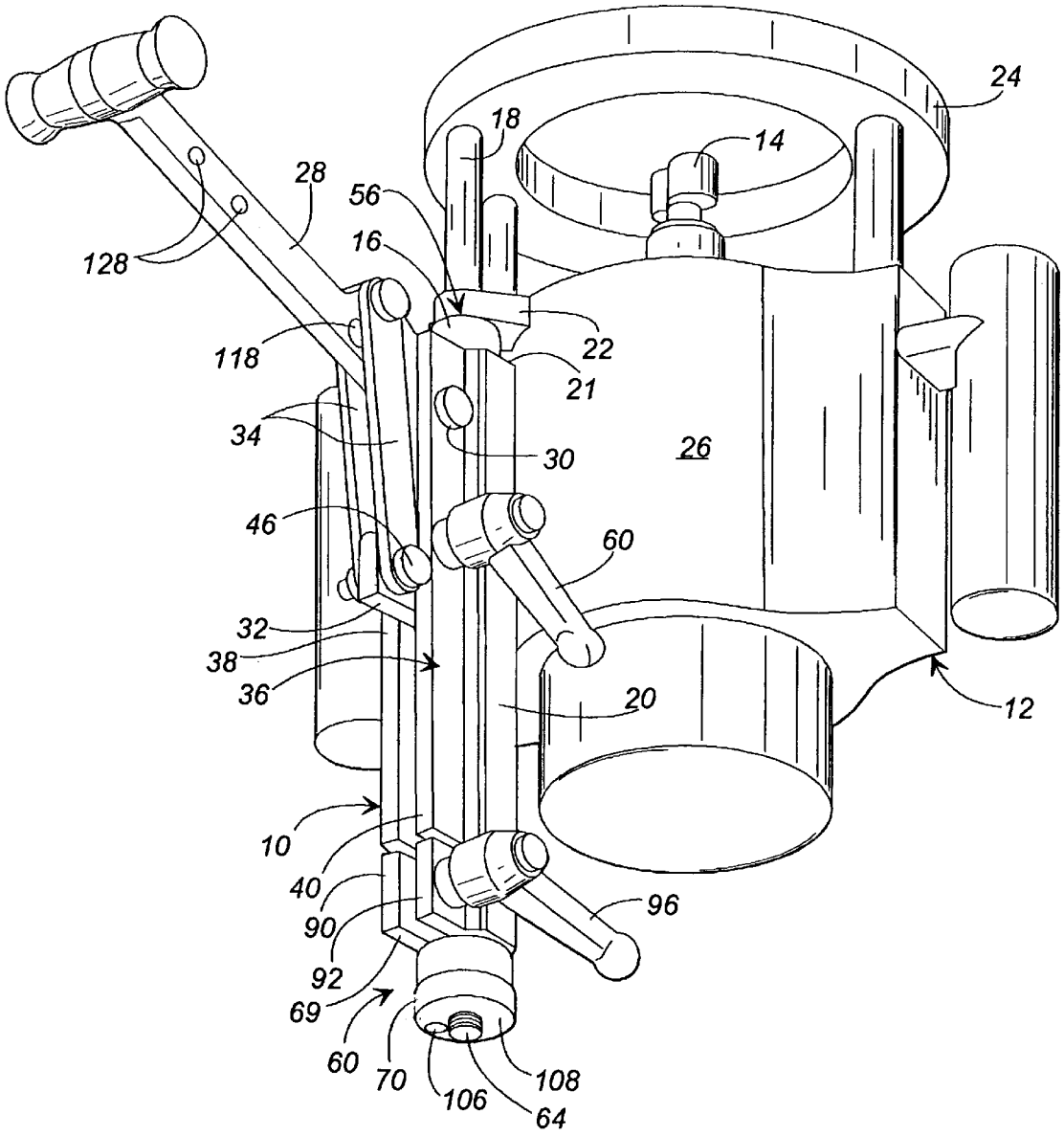
FIG. 1 is a perspective view of the router bit positioning mechanism of this invention shown in position on a plunge router oriented upside down as it would be when mounted in a router table (not shown).

As is illustrated in FIG. 1, the router bit positioning mechanism 10 of this invention is attached to an electric router 12 having a bit or cutter 14. The mechanism 10 attaches to plunge router 12 by threading piston 16 onto the threaded adjust rod 18 on router 12. Threaded rods like rod 18 are present on most plunge routers; typically one or two nuts threaded onto such a rod 18 may be positioned on the rod 18 to contact a ledge 22 attached to or a part of the router body 26. This contact limits the retraction of router body 26 from router base 24 when the base 24 is not locked and gravity or springs (not shown) in the router 12 force the router body 26 and base 24 apart. When the router 12 is used upside down in a router table, the weight of the router body 26 alone is typically adequate to urge the body 26 down away from the base 24. Consequently, it is often desirable to remove the springs when using a router 12 in a router table with mechanism 10.

The top 21 of body 20 (within which body 20 piston 16 travels) bears against ledge 22 through which adjust rod 18 of router 12 passes. Thus, drawing piston 16 into body 20 draws adjust rod 18 through ledge 22 while the top 21 of body 20 presses against ledge 22 on router body 26, thereby causing the router body 26 to move toward router base 24. This causes router bit 14 to project through base 24 and through the router table (not shown) to which base 24 is attached.

Figure 2:
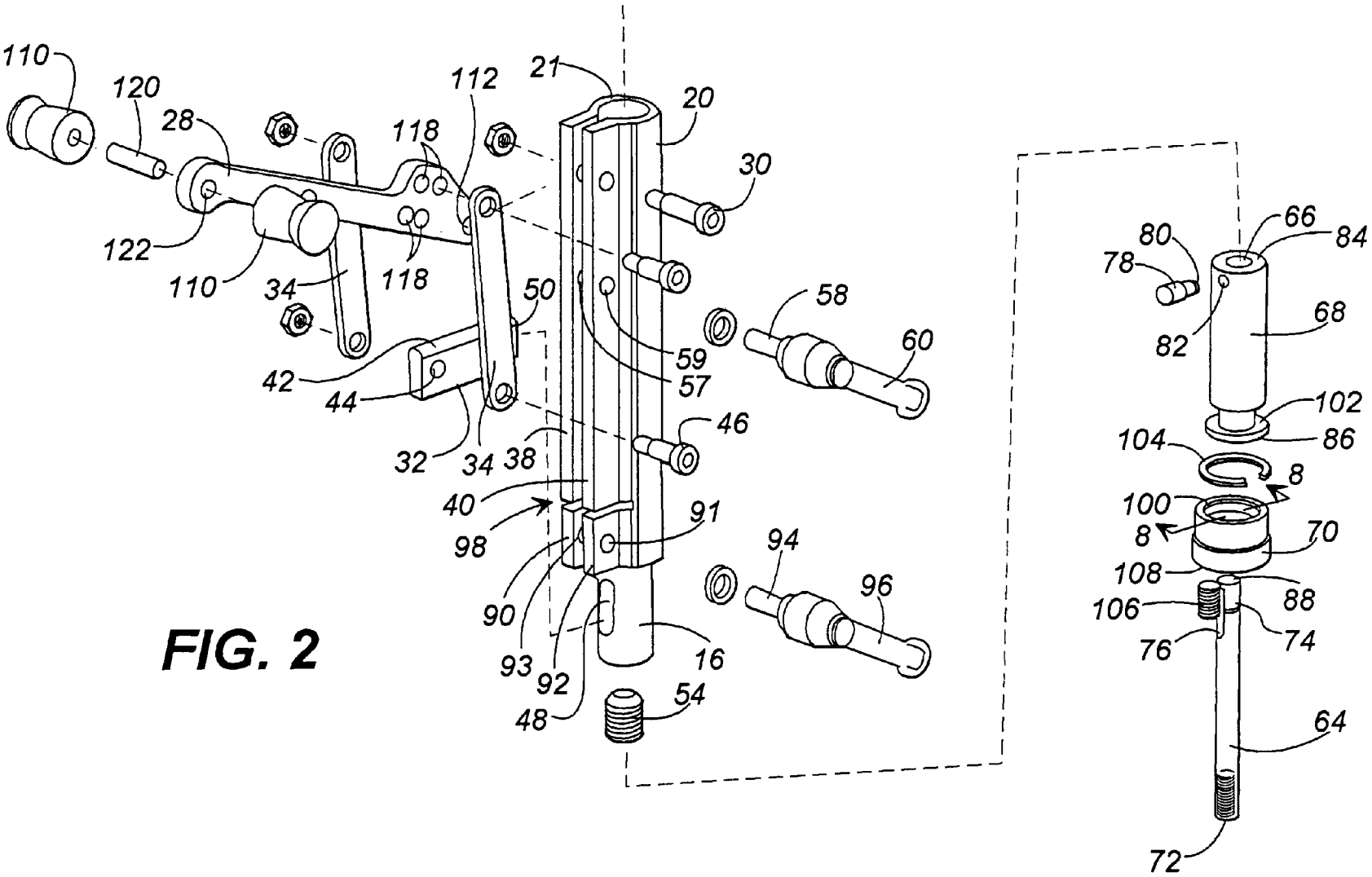
FIG. 2 is an exploded perspective view of the router bit positioning mechanism shown in FIG. 1.

As will be appreciated by reference to FIGS. 1 and 2, relatively substantial adjustments in the position of piston 16 within body 20 (and thus in the position of bit 14) are made by manipulating handle 28 up and down. Handle 28 pivots on shoulder screw 30 and is coupled to piston arm 32 by links 34. Piston arm 32 slides within a groove 36 defined generally by parallel plates 38 and 40 that project from body 20. Piston arm 32 is a generally rectangular plate, preferably having one rounded edge 42 and a hole 44 near one end of the arm 32. A link attaching screw 46 passes through hole 44 to attach links 34 to piston arm 32. The end 50 of piston arm 32 remote from hole 44 is received in a slot 48 near the lower end 52 of piston 16.

The lower end 52 of piston 16 is internally threaded to receive a set screw 54. When the end 50 of piston arm 32 is inserted in slot 48 of piston 16, set screw 54 is tightened against piston arm 32, forcing the upper edge 42 of piston arm 32 against the wall of slot 48, thereby locking it in position.

The upper end 56 of piston 16 is also internally threaded so that it may be threaded onto adjust rod 18 of router 12. Thread pitch and diameter in the upper end 56 of piston 16 must, of course, be matched to the thread pitch and diameter of adjust rod 18 supplied with the particular router 12 being used.

Bit positioning mechanism 10 is mounted on router 12 by first threading piston 16 onto adjust rod 18 and then sliding piston 16 into body 20, after which piston arm 32 is attached to piston 16 as is described above.

Piston 16 may be locked within body 20 by drawing plates 38 and 40 together, thereby squeezing body 20 tightly around piston 16. This may be accomplished by tightening locking stud 58 with gyratory handle 60 (which might also be a generally round or Tee-shaped knob secured to stud 58). Stud 58 passes through a smooth bore 59 in plate 40 and into a threaded bore 57 in plate 38.

Figure 4:
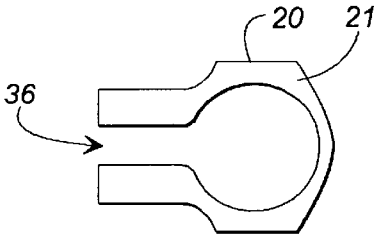
FIG. 4 it is a top plan view of the body of the positioning mechanism shown in FIG. 1.

Body 20 may be extruded aluminum and can be anodized for reduced friction and enhanced wear-resistance. It may have the cross-sectional shape shown in FIG. 4 and visible at the top of body 20 in FIG. 2.

Fine adjustments in the router bit 14 position may be made utilizing a micro-adjust mechanism 60 that is positioned in and below lower end 69 of body 20. Micro-adjust mechanism 60 includes a spindle 64 positioned in a smooth bore 66 in a generally cylindrical micro-adjust body or cylinder 68. The position of spindle 64 within micro-adjust cylinder 68 is established by adjusting knob 70, which is threaded onto the lower, externally threaded end 72 of spindle 64 and is rotatably secured to cylinder 68. The upper, unthreaded end 74 of spindle 64 has a longitudinal recess or groove 76. A key screw 78 having a smooth end 80 is threaded into a hole 82 in the side of cylinder 68 near its upper end 84 so that the smooth end 80 of key screw 78 is received in longitudinal groove 76 in spindle 64. This permits spindle 64 to move along its longitudinal axis within micro-adjust cylinder 68 but prevents spindle 64 from rotating within cylinder 68. Because knob 70 is captured on the lower end 86 of cylinder 68, and is also threaded onto the threaded end 74 of spindle 64, rotation of knob 70 causes spindle 64 to move axially within cylinder 68. Because the threads on spindle 64 and in knob 70 are relatively fine, axial motion of spindle 64 in response to a small rotation of knob 70 is modest.

By capturing micro-adjust cylinder 68 in the lower end 69 of mechanism body 20, piston 16 can be permitted to rest on the upper 88 of spindle 64. Thus, rotation of knob 70 causes controlled axial movement of piston 16, and therefore of router bit 14. Micro-adjust cylinder 68 may be captured in mechanism body 20 by squeezing together plates 90 and 92 by tightening threaded stud 94 with gyratory handle 96. Threaded stud 94 passes through a smooth bore 91 in plate 92 and is threaded into a threaded hole 93 in plate 90. (Each of gyratory handles 60 and 96 could be replaced by knobs, cam-acting tightening levers, rusty C-clamps or any other mechanism usable to squeeze together the pairs of plates with which they are associated).

As may be seen by reference to FIG. 2, plates 90 and 92 are simply separated from plates 38 and 40 by a lateral cut 98 into body 20, which permits the pair of plates 38 and 40 to be squeezed separately from pair 90 and 92. The head of key screw 78 is received within groove 36 between the pairs of plates 90 and 92 or 38 and 40 when inserting micro-adjust mechanism 60 in body 20.

Figure 8:
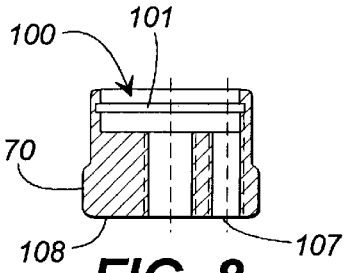
FIG. 8 is a section view taken along lines 8—8 through the micro adjust knob in FIG. 2.

As may be seen by reference to FIG. 8, knob 70 has a large blind bore 100, which receives a disk-shaped portion 102 that projects from the lower end 86 of micro-adjust cylinder 68. Disk 102 is captured in the bore 100 in knob 70 by an internal retaining ring 104 that is received in an annular recess 101 in the wall of bore 100 in knob 70.

Figure 5:
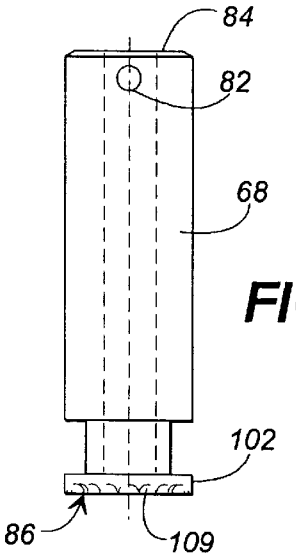
FIG. 5 is a side elevation view of the micro-adjust cylinder of the positioning mechanism shown in FIG. 1.
Figure 7:
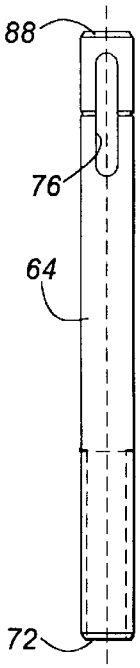
FIG. 7 is a side elevation view of the spindle of the micro-adjust mechanism of this invention.
Figure 6:
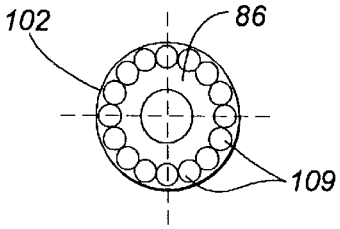
FIG. 6 is a bottom plan view of the micro-adjust cylinder shown in FIG. 5.
Figure 9:
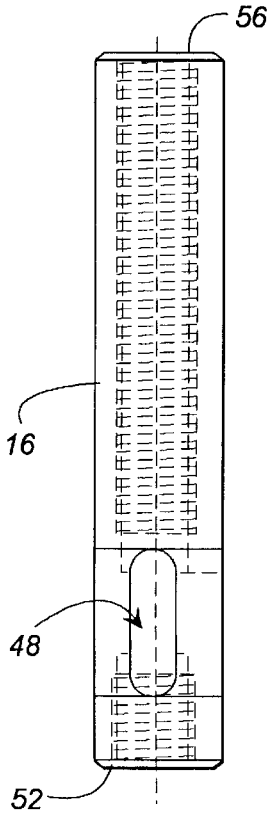
FIGS. 9 is a side elevation view of the piston of the positioning mechanism shown in FIG. 1.

Small, predetermined increments of angular rotation of knob 70 are achieved by a interaction between a detent mechanism, such as a ball detent set screw or rod detent set screw 106, and recesses in the lower face or end 86 of disk 102. Ball detent set screw or rod detent set screw 106 is threaded into a threaded hole 107 in the lower face 108 of knob 70 so that the spring loaded end of detent set screw 106 bears against the lower face 86 of disk 102. As shown in FIGS. 5 and 6, the face 86 of disk 102 is machined with sixteen equally spaced spherical cavities 109 that fall under detent set screw 106 as knob 70 is rotated, thereby causing knob 70 to move around cylinder 68 and spindle 64 in angular increments of 22.5 degrees. (Different increments can, of course, be achieved by differently spacing the spherical cavities 109). With a thread pitch of thirty-two threads per inch on knob 70 and spindle 64, each such 22.5 degree rotation of knob 70 will move spindle 64 axially by an increment of 0.002 inch. This permits very precise positioning of bit 14. The detent mechanism 106 could alternatively be positioned in disk 102 while cavities 109 are located in knob 70.

Figure 3:
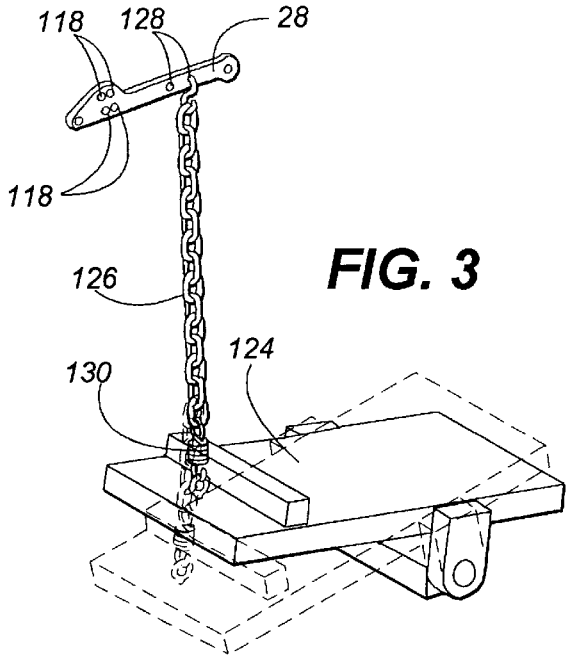
FIG. 3 is a perspective view of the handle of the router bit positioning mechanism of this invention attached to a foot pedal.

In order to use router bit positioning mechanism 10, handle 28 is manipulated using knobs 110 or the foot control illustrated in FIG. 3 and described below preliminarily to position router bit 14 in approximately a desired location. Cylinder 68 of micro-adjust mechanism 60 is then raised within micro-adjust body 20 so that the upper end 88 of spindle 64 abuts set screw 54 in piston 16. Gyratory handle 96 is then rotated so that stud 94 draws plates 92 and 90 together, thereby locking micro-adjust cylinder 68 within body 20. Stud 58 controlled by handle 60 remains loose or is loosened so that piston 16 may slide up and down freely within body 20.

Micro-adjust knob 70 is then rotated until the exact desired position of router bit 14 is achieved. Handle 60 may then be rotated so that stud 58 will draw plates 38 and 40 together, thereby locking piston 16 within body 20 and, consequently, locking router body 26 and router bit 14 in the desired location.

As may best be seen by reference to FIG. 2, handle 28 is penetrated by several holes. Axle hole 112 receives shoulder screw or pivot screw 30 on which handle 28 pivots. Links 34 that attach at their lower ends to piston arm 32 attach, at their upper ends 116, to any of several holes 118 in handle 28.

Multiple holes 118 in handle 28 are provided for two reasons. First, holes 118 at the same radial distance from pivot screw 30 permit handle 28 to assume different positions relative to a given position of piston 16 within body 20. This allows the user of router bit positioning mechanism 10 to accommodate different conditions resulting from the use of mechanism 10 with different routers 12 and router tables, thereby increasing the likelihood that handle 28 can be located in a convenient position without obstructing or encountering other objects. The second reason for multiple holes 118 is that such holes at different distances from pivot screw 30 provide different "sensitivity" for handle 28. Attachment of links 34 to a hole 118 in handle 28 that is closer to pivot screw 30 will mean that handle 28 must pivot through a greater angle to achieve movement of piston 16 (and therefore bit 14) a given distance (but that less force will be required to move handle 28) than if links 34 are attached at a hole 118 in handle 28 that if further from pivot screw 30.

As may be seen by reference to FIGS. 1 and 2, knobs 110 are positioned on opposite ends of a headless set screw 120 that passes through a hole 122 in the end of handle 28 remote from body 20.

As is apparent from FIG. 1, handle 28 can be manipulated by grasping knobs 110. An alternative mechanism for manipulation of handle 28 using a foot pedal is desirable in many instances. Such a foot petal 124 is illustrated in FIG. 3. Foot petal 124 is attached to handle 28 by a chain 126 fixed in one of the holes 128 in handle 28. Base spring 130 may be part of the linkage between handle 28 and foot pedal 124 So that actuation of foot pedal 124 when piston 16 is locked in body 20 will not damage any of the components of positioning mechanism 10.

As will be appreciated by those skilled in the design and use of tools, numerous modifications can be made in router bit positioning mechanism 10 described above that are within the spirit of this invention and that are within the scope of the following claims. For instance, a wide variety of structures other than the one illustrated in the drawings and described above could be used for micro-adjust mechanism 60. Such alternatives included simplified versions of the mechanism described above (omitting, for instance, the detent set screw feature), and alternative approaches could be used, such as geared mechanisms and different screw-containing mechanisms. The principal requirement of any such micro-adjust mechanism 60 is that it provide a relatively easy way to make small adjustments in the position of router bit 14 by making small changes in the position of router body 26 relative to router base 24.

Other changes can likewise be made in other elements of the structure of bit positioning mechanism 10 while achieving the fundamental benefits of this invention: the capacity easily to adjust the position of a plunge router body relative to its base by both substantial and very small amounts, particularly when the router is mounted upside down in a router table, so that the projection of a router bit through a router table can be easily and very accurately adjusted. For instance, the lever-actuated piston described above might instead be a screw arrangement or a rack and pinion gear arrangement, among numerous other alternatives.

I claim:

1. A router adjustment mechanism for use with a router having a base and a body, the adjustment mechanism comprising:

(a) means for attachment to the router base, (b) means for contact with the router body, (c) means for moving the base attachment means relative to the router body contact means by relatively substantial increments and (d) means for moving the base attachment means relative to the router body contact means by relatively small increments.

2. A mechanism for actuating the plunge capability of a plunge router having a router body and a base, comprising a hand actuatable lever that, when moved a particular distance, causes the router body to move relative to the base a distance smaller than the particular distance.

3. The mechanism of claim 2, further comprising a foot actuatable pedal coupled to the lever.

4. The mechanism of claim 2, further comprising a micro-adjust mechanism for adjusting the position of the router body relative to the base by relatively small distances.

5. A mechanism for positioning a tool having a first tool portion and a second tool portion movable toward or away from the first tool portion, the positioning mechanism comprising:

(a) a hand actuatable lever that, when moved a particular distance, causes the first tool portion to move relative to the second tool portion a distance shorter than the particular distance, and (b) a micro-adjust mechanism for adjusting the relative positions of the first and second tool portions by small distances.

6. A router adjustment mechanism for use with a router having: (i) a base to which an adjustment rod is attached and (ii) a body having a ledge, the adjustment mechanism comprising:

(a) a piston for attachment to the rod, (b) a body for contact with the ledge, (c) a lever attached to the body and to the piston for movement of the piston relative to the body.

7. The router adjustment mechanism of claim 6, wherein the body is an elongated member having a cross-sectional shape defining an elongated cylindrical passage communicating with an elongated groove defined by at least one pair of generally parallel plates.

8. The router adjustment mechanism of claim 6, further comprising a micro-adjust mechanism for moving the piston relative to the body by small increments of movement.

9. The router adjustment mechanism of claim 8, wherein the micro-adjust mechanism comprises a cylinder positionable within the body, a spindle positioned for longitudinal movement within the cylinder, a knob rotatably attached to the cylinder and threaded onto the spindle for rotation about the spindle to impart longitudinal movement to the spindle relative to the cylinder.

10. The router adjustment mechanism of claim 9, further comprising a detent mechanism in one of the knob or the cylinder for contact with recesses in the other of the knob or the cylinder to make the knob readily positionable in predetermined rotational positions established by the angular separation between the recesses.

11. The router adjustment mechanism of claim 7, wherein the lever has two ends, one of which ends is secured between the plates so that the lever can pivot up and down, and a connection between the handle and the piston causes pivoting movement of the lever to force the piston to travel within the cylindrical passage within the body.

12. The router adjustment mechanism of claim 11, wherein the lever is connected to the piston through at least one link attached to a piston arm secured to the piston.

13. The router adjustment mechanism of claim 12, wherein the link is attachable to the lever in more than one position on the lever.

14. The router adjustment mechanism of claim 11, wherein the piston arm travels within the groove defined by the plates.

15. The router adjustment mechanism of claim 7, wherein the piston may be secured within the cylindrical passage by forcing the plates together and thereby squeezing the piston within the passage.

16. The router adjustment mechanism of claim 7, wherein the piston may be secured within the cylindrical passage by rotating a threaded stud to draw the plates together and thereby squeeze the piston within the passage.

17. The router adjustment mechanism of claim 9, wherein the micro-adjust cylinder it is secured within the cylindrical passage within the body by drawing the plates together and thereby squeezing the cylinder within the passage.

18. The router adjustment mechanism of claim 6, wherein the adjust rod is threaded and is received within a threaded bore in one end of the piston.

19. The router adjustment mechanism of claim 6, further comprising a chain for attaching the lever to a foot pedal.

20. The router adjustment mechanism of claim 19, wherein the chain is attachable to the lever in more than one position.

21. The router adjustment mechanism of claim 19, further comprising a spring for attaching the chain to the foot pedal.

22. A mechanism for adjusting the position of a plunge router body relative to its base to which a threaded adjustment rod is attached, the mechanism comprising:

(a) an extruded aluminum body having an elongated cylindrical passage and a pair of parallel plates protruding alongside the passage and defining a groove between the plates that is open to the passage, (b) a cylindrical piston sized to slide within the passage and having:

(i) a threaded bore in one end of the piston for receiving the threaded rod, (ii) a threaded bore for receiving a set screw in the other end of the piston, and (iii) a generally rectangular recess in the wall of the piston communicating with the set screw bore, (c) a piston arm positioned partially within the groove and secured within the recess in the piston by a set screw positioned in the set screw bore, (d) a handle having an end that pivots on a screw passing through the plates, (e) at least one link attached between the handle and the piston arm so that pivoting the handle causes the piston arm to slide within the groove and move the piston axially within the passage, (f) a threaded stud passing through a smooth bore in one of the plates and into a threaded bore in the other plate for drawing the plates together in order to lock the piston within the passage, (g) a micro-adjust mechanism comprising:

(i) a cylinder positionable within one the end of the passage, (ii) a spindle:

(1) positioned to slide axially with an axial bore in the cylinder, and (2) and having a rectangular recess near one end, (iii) a set screw positioned in a wall of the cylinder to extend into the axial bore in the cylinder and into the rectangular recess in the spindle, (iv) a threaded knob rotatably secured to the cylinder and threaded onto the other end of the spindle so that rotation of the knob moves the spindle axially within the cylinder (h) a second threaded stud passing through a second smooth bore in one of the plates and into a second threaded bore in the other plate for drawing the plates together in order to lock the micro-adjust cylinder within the passage.

23. The router adjustment mechanism of claim 22, wherein the micro-adjust mechanism further comprises a detent set screw in the knob to engage detents in the cylinder.

24. A method for adjusting the position of a router bit relative to a router table to which a plunge router having a router base and a router body holding the bit is attached, the method comprising the steps of:

(a) attaching a plunger to the router base, (b) contacting the router body with a sleeve within which the plunger is positioned, (c) manipulating a handle to move the plunger within the sleeve and thereby move the router body relative to the router base, (d) coupling a micro-adjust mechanism to the plunger and the sleeve, (e) moving the plunger within the sleeve by a small amount using the micro-adjust mechanism, and (f) locking the plunger within the sleeve.

25. A method for adjusting the position of a router bit relative to a router table to which a plunge router having a router base and a router body holding the bit is attached, the method comprising the steps of:

(a) connecting apparatus having coarse adjustment portions and fine adjustment portions to the router base and the router body, (b) using course the adjustment portions of the apparatus to move the router base relative to the router body by a relatively substantial distance, (c) using the fine adjustments portions of the apparatus to move the router base relative to the router body by a relatively small distance, and (d) locking the apparatus to fix the position of the router base relative to the router body.

26. The method of claim 25, wherein the coarse adjustment portions comprise a plunger for attachment to the router base and for movement within a sleeve and a lever acting between the sleeve and the piston to move the position of the piston within the sleeve.

27. The method of claim 25, wherein the fine adjustment portions comprise a cylinder positionable within the sleeve and against an end of the plunger, a spindle slidable within an axial bore in the cylinder and a knob rotatably attached to the cylinder and threaded onto the spindle for rotation about the spindle to impart axial motion to the spindle within the cylinder and against the plunger.

28. A method for adjusting the position of a router bit relative to a router table to which a plunge router having a router base and a router body holding the bit is attached, the method comprising the steps of:

(a) manipulating a lever generally in one direction relative to the base to cause the router body to move generally in the opposite direction relative to the base, and (b) manipulating a micro-adjust mechanism to adjust the relative positions of the router body and base by a small distance until a desired bit location is achieved.

29. The method of claim 28 in which the lever may be manipulated in step (a) by hand or by foot.

* * * * *